US006887125B2

(12) United States Patent
Kurogouchi

(10) Patent No.: US 6,887,125 B2
(45) Date of Patent: May 3, 2005

(54) POLISHING APPARATUS, POLISHING METHOD, CONTROL PROGRAM FOR CAUSING COMPUTER TO EXECUTE POLISHING, AND RECORDING MEDIUM

(75) Inventor: Toshio Kurogouchi, Ina (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/310,627

(22) Filed: Dec. 5, 2002

(65) Prior Publication Data

US 2003/0096562 A1 May 22, 2003

Related U.S. Application Data

(63) Continuation of application No. PCT/JP02/03604, filed on Apr. 11, 2002.

(30) Foreign Application Priority Data

Apr. 11, 2001 (JP) ..... 2001-112709

(51) Int. Cl.[7] ..... B24B 1/00

(52) U.S. Cl. ..... 451/5; 451/38; 451/48; 451/75; 76/108.6

(58) Field of Search ..... 451/5, 38, 39, 451/40, 48, 82, 91, 75, 89, 79; 76/5.1, 108.6

(56) References Cited

U.S. PATENT DOCUMENTS 5,636,558 A 6/1997 Sanders et al.
5,709,587 A * 1/1998 Shaffer ..... 451/38
5,759,086 A * 6/1998 Klingel ..... 451/28
5,791,968 A * 8/1998 Matsumura et al. ..... 451/5
5,910,338 A * 6/1999 Donde ..... 427/290
5,951,369 A 9/1999 Kordonski et al.
5,971,835 A 10/1999 Kordonski et al.
6,168,502 B1 * 1/2001 Allman et al. ..... 451/38
6,244,934 B1 * 6/2001 Miyai et al. ..... 451/38
6,305,261 B1 * 10/2001 Romanini ..... 83/53
6,733,369 B1 * 5/2004 Stacklies et al. ..... 451/42

FOREIGN PATENT DOCUMENTS

| | | | |
|---|---|---|---|
| DE | 26 07 097 | A1 | 8/1977 |
| JP | 3-136769 | A | 6/1991 |
| JP | 05-057591 | A | 3/1993 |
| JP | 05-771151 | A | 3/1993 |
| JP | 05-201737 | A | 8/1993 |
| JP | 5-253841 | A | 10/1993 |
| JP | 05-277975 | A | 10/1993 |
| JP | 2000-127044 | A | 5/2000 |
| JP | 2000-320792 | A | 11/2000 |
| JP | 2001-92514 | A | 4/2001 |

* cited by examiner

*Primary Examiner*—Lee D. Wilson
*Assistant Examiner*—Anthony Ojini
(74) *Attorney, Agent, or Firm*—Frishauf, Holtz, Goodman & Chick, P.C.

(57) ABSTRACT

A polishing apparatus includes a table on which a polishing target member is placed, and at least one nozzle which sprays a polishing solution to a surface of the polishing target member so as to form, by polishing, the surface of the polishing target member. The nozzle and the polishing target member move relative to each other, and an angle of the nozzle is changeable.

11 Claims, 4 Drawing Sheets

POLISHING APPARATUS, POLISHING METHOD, CONTROL PROGRAM FOR CAUSING COMPUTER TO EXECUTE POLISHING, AND RECORDING MEDIUM

CROSS-REFERENCE TO RELATED APPLICATIONS

This is a Continuation Application of PCT Application No. PCT/JP02/03604, filed Apr. 11, 2002, which was not published under PCT Article 21(2) in English.

This application is based upon and claims the benefit of priority from the prior Japanese Patent Application No. 2001-112709, filed Apr. 11, 2001, the entire contents of which are incorporated herein by reference.

BACKGROUND OF THE INVENTION

1. Field of the Invention

The present invention relates to a polishing apparatus and a polishing method of polishing a surface of an optical member or a substrate by spraying a fluid or an abrasive suspension thereto, a control program for causing a computer to execute polishing, and a recording medium.

2. Description of the Related Art

Conventionally, a technique for polishing a surface of an optical member or substrate by the jet of a fluid or abrasive suspension is disclosed.

For example, Jpn. Pat. Appln. KOKAI Publication No. 5-57591 discloses the following technique. A lens is held by the pressure of a polishing solution jetted out from large numbers of holes in tools arranged above and under the lens. The two surfaces of the lens are entirely polished simultaneously by rotating the jet ports of the polishing solution and the lens relative to each other. According to the technique disclosed in Jpn. Pat. Appln. KOKAI Publication No. 5-57591, however, the two surfaces of the lens are polished entirely. It is impossible to select only part of the lens and polish only the selected part.

Jpn. Pat. Appln. KOKAI Publication No. 5-201737 discloses the following technique. Cutting of a glass sheet and polishing of the cut glass edge are performed by using a jet solution of an abrasive suspended in water. In this manner, according to the technique disclosed in Jpn. Pat. Appln. KOKAI Publication No. 5-201737, cutting and grinding of the cut surface are performed by jetting out to the glass sheet a jet solution suspended with the abrasive. Thus, a tool for jetting out the jet solution jets out the jet solution while moving parallel to and perpendicularly to the glass sheet surface. With this technique, a surface having a concave or convex as in an optical lens cannot be polished. Also, Jpn. Pat. Appln. KOKAI Publication No. 5-201737 does not disclose any means that changes the jetting direction of the jet.

U.S. Pat. No. 5,951,369 discloses the following technique. A flange attached with a polishing solution suspended with magnetic abrasive particles is rotated. This changes the strength of the magnetic field at a polishing portion. Thus, the concentration of the magnetic abrasive particles is changed, so that the polishing amount is controlled. According to the technique disclosed in U.S. Pat. No. 5,951,369, the polishing solution suspended with the magnetic abrasive particles is attached to the periphery of the flange, and the flange is brought into contact with a polishing zone, so that polishing limited to the contact zone is enabled. With this method, the polishing amount can be changed in accordance with the strength of the magnetic field. The polishing amount also changes largely in accordance with the urging force of the flange against the polishing zone. The relationship between the urging force and adjustment of the polishing amount, however, is not disclosed. Hence, it is difficult to finely adjust the polishing amount of the polishing zone.

U.S. Pat. No. 5,971,835 discloses the following technique. While a fluid suspended with magnetic abrasive particles is sprayed to a rotating workpiece, the spraying direction is controlled by a solenoid. The polishing position is thus adjusted. According to the technique disclosed in U.S. Pat. No. 5,971,835, the change amount of the fluid spraying direction against the workpiece is very small. Accordingly, it is difficult to spray a solution to an uneven surface, that changes largely in the direction of normal to the work surface, perpendicularly or at a constant angle.

BRIEF SUMMARY OF THE INVENTION

It is an object of the present invention to provide a polishing apparatus and polishing method which can realize high-precision polishing, a program for causing a computer to execute polishing, and a recording medium.

A polishing apparatus according to an aspect of the present invention is characterized by comprising a table on which a polishing target member is placed, and at least one nozzle which forms and polishes a surface of the polishing target member by spraying a polishing solution to the surface of the polishing target member, wherein the nozzle and the polishing target member move relative to each other, and an angle of the nozzle is changeable.

The preferred embodiments of the polishing apparatus described above are as follows. The following embodiments may be adopted singly or in appropriate combinations.

(1) The polishing target member is placed on a rotatable table.

(2) The polishing apparatus further comprises means for controlling a time during which the polishing solution is sprayed.

(3) The nozzle is detachably attached to a main body of the polishing apparatus.

(4) The nozzle is attached to make a direction of the nozzle and a position of the nozzle in a rotational direction about an axis along a jetting direction of the polishing solution from the nozzle constant.

A polishing method according to another aspect of the present invention is, a method of forming and polishing a surface of the polishing target member by placing a polishing target member on a table and spraying a polishing solution from at least one nozzle, characterized in that the nozzle and the polishing target member move relative to each other, and an angle of the nozzle is changeable.

A control program according to still another aspect of the present invention is a control program which is to be executed by a computer used by a polishing method of forming and polishing a surface of the polishing target member by placing a polishing target member on a table and spraying a polishing solution from at least one nozzle, the method being characterized in that the nozzle and the polishing target member move relative to each other, and an angle of the nozzle is changeable, characterized in that the control program displays shape data of the polishing target member before the process, and records and displays a process condition preset on the basis of the shape data.

A recording medium according to still another aspect of the present invention is a recording medium which records a control program to be used by a polishing method of forming and polishing a surface of the polishing target member by placing a polishing target member on a table and spraying a polishing solution from at least one nozzle, the method being characterized in that the nozzle and the polishing target member move relative to each other, and an angle of the nozzle is changeable, characterized in that the recording medium records a control program which displays shape data of the polishing target member before the process, and which records and displays a process condition preset on the basis of the shape data.

According to the respective aspects of the present invention, the distance, angle, spraying time, and the like as the spraying conditions for the polishing solution from the nozzle can be controlled freely in accordance with the surface shape of the polishing target member. In addition, the nozzle for spraying the polishing solution can be exchanged, and a plurality of nozzles can be provided. Therefore, high-precision polishing can be realized under conditions that are optimal for the polishing target member.

DETAILED DESCRIPTION OF THE INVENTION

The embodiments of the present invention will be described with reference to the drawings.

(First Embodiment)

Figure 1:
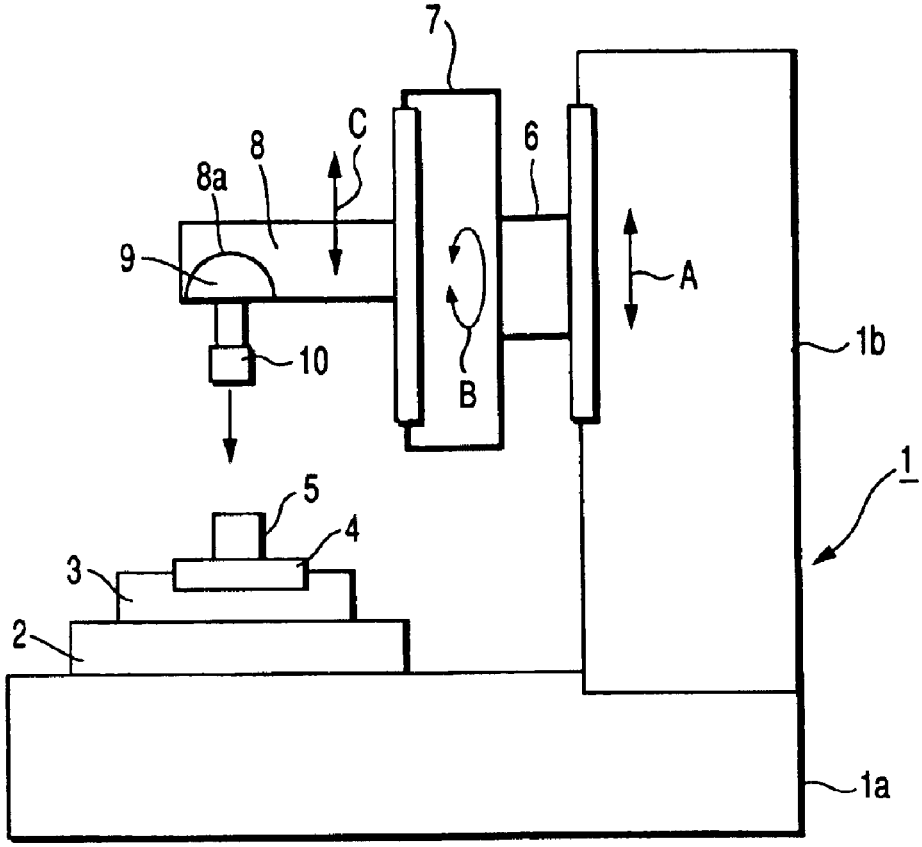
FIG. 1 is a view showing a schematic arrangement of a polishing apparatus applied to the first embodiment of the present invention.

FIG. 1 shows a schematic arrangement of a polishing apparatus to which the present invention is applied. Referring to FIG. 1, an apparatus main body 1 has a base 1*a* and a trunk 1*b* provided upright on the base 1*a*.

A work-table 2 is formed on the base 1*a* of the apparatus main body 1. A work rotation table 3 is formed on the work-table 2. The work-table 2 holds the work rotation table 3 to be movable in an X-Y direction (on a plane perpendicular to the surface of the sheet of FIG. 1; "X-Y direction" or the like hereinafter refers to a direction along a plane perpendicular to the surface of the sheet of FIG. 1). The work rotation table 3 is rotatable on the work-table 2 about a Z-axis (a direction along the Z-axis will be referred to as a "Z-axis direction" hereinafter) perpendicular to the X-Y direction as the center.

A chuck 4 is formed on the work rotation table 3. The chuck 4 fixes a polishing target member 5. When the polishing target member 5 has such a shape that its central position must be obtained like a lens, it can be centered by the work rotation table 3 and the centering mechanism of the chuck 4. The centering mechanism is a mechanism that causes the rotation center of the work rotation table 3 and the center to be obtained of the polishing target member 5 to coincide with each other. For example, the centering mechanism can be realized by enabling fine adjustment of the chuck 4 on the work rotation table 3 in X and Y directions. Assume that the central position of the polishing target member 5 need not be obtained because, e.g., the polishing surface of the polishing target member 5 is a flat surface. In this case, a stationary chuck is used as the chuck 4. In the above manner, the chuck 4 is exchanged and used in accordance with the shape of the polishing target member 5 and the polishing conditions.

A Z-axis stage may be provided between the work rotation table 3 and chuck 4, so that the polishing target member 5 can be moved in the Z-axis direction. The work-table 2 may be formed such that a plurality of polishing target members 5 can be placed on it.

The trunk 1*b* of the apparatus main body 1 has a support arm 6 to be vertically movable in the direction of an arrow A in FIG. 1. The support arm 6 has a rotary base 7 at its distal end. The rotary base 7 is supported at the distal end of the support arm 6 to be rotatable in the direction indicated by an arrow B in FIG. 1. The rotary base 7 has a nozzle table 8. The nozzle table 8 is linearly movable on the rotary base 7 in the direction of an arrow C in FIG. 1.

The nozzle table 8 has a nozzle 10 which jets out a polishing solution through a rotary base 9. The rotary base 9 has the structure of a semispherical shape or a so-called universal joint which is fitted in a semispherical reception groove 8*a* of the nozzle table 8. Hence, the direction of the nozzle 10 with respect to the polishing target member 5 can be changed freely.

Figure 2A:
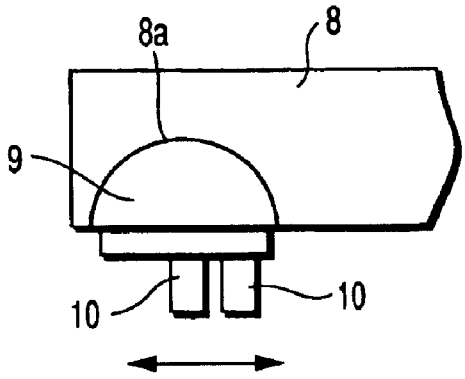
FIGS. 2A and 2B are views for explaining cases of the first embodiment that have plurality of nozzles.
Figure 2B:
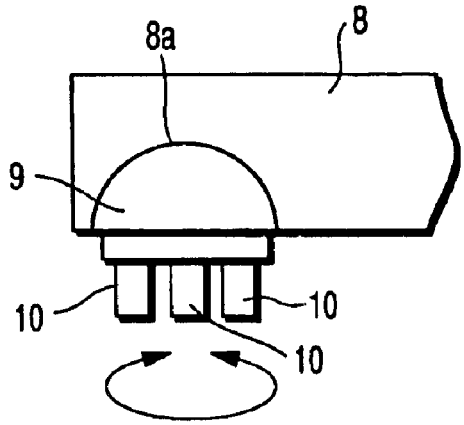

The nozzle 10 may be translatable in the X and Y directions. A piezoelectric element may be interposed between the rotary base 9 and nozzle 10 in order to adjust the direction in which the polishing solution is to be jetted out. The nozzle 10 may be finely driven by utilizing deformation of the piezoelectric element. The nozzle 10 need not be limited to one, but a plurality of nozzles 10 may be provided. In this case, for example, the following arrangement may be possible. As shown in FIG. 2A, a plurality of nozzles 10 may be lined up in a row on the rotary base 9, and may be linearly moved in the direction of an arrow of FIG. 2A. Hence, a desired nozzle 10 can oppose the polishing target member 5. Alternatively, as shown in FIG. 2B, a rotary arrangement such as a turret or revolver may be employed. Namely, a plurality of nozzles 10 may be arranged on the rotary base 9 in the circumferential direction, and may be rotatably moved in the direction of an arrow of FIG. 2B. Then, a desired nozzle 10 opposes the polishing target member 5. A plurality of sets each consisting of a support arm 6, rotary base 7, nozzle table 8, and rotary base 9 may be provided to the trunk 1*b* of the apparatus main body 1. With this arrangement, the polishing solution can be sprayed from the plurality of nozzles simultaneously to one portion or portions close to each other of the polishing target member 5. For example, in the polishing step, the plurality of nozzles must sometimes be arranged at angles with each other because the rotary base 9 or nozzle table 8 interferes. Even in this case, a former processing zone and a later processing zone can be processed simultaneously. As means for holding the nozzle 10 and moving or rotating the nozzle 10, a multi-axial robot disclosed in Jpn. Pat. Appln. KOKAI Publication Nos. 5-077151 and 5-277975 may be used. In this case, the arm preferably has a protection cover so the abrasive will not directly attach to the arm.

In the above arrangement, alignment of the center of the polishing target member 5 and a zone to which the polishing solution is to be sprayed from the nozzle 10 will be described.

First, assume that a direction perpendicular to that plane of the polishing target member 5 which is in contact with the polishing target zone (to be referred to as a "planar direction" hereinafter) and the jetting direction from the nozzle 10 coincide with the Z direction. In this case, the center of the polishing target member 5 and the rotation center of the work rotation table 3 coincide with each other by fine adjustment of the chuck 4. Accordingly, alignment with the polishing target zone as the object can be performed by only setting the X- and Y-coordinates of the work-table 2 and the X- and Y-coordinates of the nozzle 10 to coincide with each other.

Assume that the planar direction of the polishing target zone and the jetting direction from the nozzle 10 do not coincide with the Z direction. Namely, assume that the polishing solution from the nozzle 10 is to be sprayed from above to the polishing target zone of the polishing target member 5. In this case, the Z-direction coordinates of the target polishing zone of the polishing target member 5, i.e., the height, must be determined. For this purpose, the surface shape of the polishing target zone of the polishing target member 5 is measured in advance. The Z-direction coordinates are determined on the basis of the measurement data. Alignment with the polishing target zone as the object is performed by means of a curvilinear coordinate to which the Z-coordinate value is added.

To measure the surface shape of the polishing target member 5 and the coordinates of the zone, an optical focal alignment method, a confocal scanning method, an interference fringe method, a three-dimensional measurement method using a contact sensor, a method using a surface roughness gauge, or the like is employed.

When a plurality of polishing target members 5 are to be placed on the work-table 2, the surface shapes and the coordinates of zones of the respective polishing target members 5 are measured before polishing. The Z-direction coordinates are determined on the basis of these data. In this case, the surface shapes of the polishing target members 5 are measured by a measurement unit (not shown). After the measurement, when the polishing target members 5 move to the polishing positions, the position or angle of the nozzle 10 with respect to predetermined polishing target zones can be determined on the basis of the measurement data. Therefore, polishing operation can be performed continuously without removing the polishing target members 5, so the operation efficiency is improved. Various surface shape data, position data, and the like used as the conditions for polishing are stored in a storage (not shown), and are used when determining the polishing zones and polishing conditions.

Figure 3:
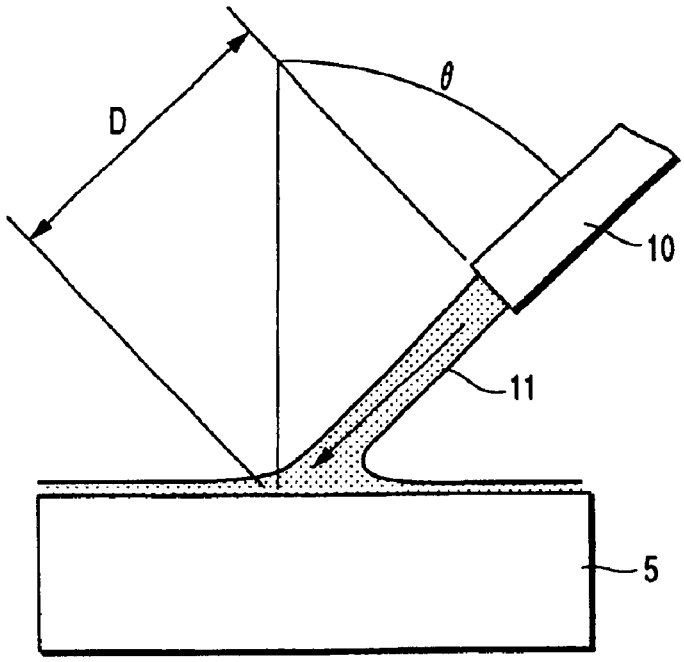
FIG. 3 is a view for explaining a state of jet of a polishing solution with respect to a polishing target member according to the first embodiment.

The polishing apparatus shown in FIG. 1 is connected to a controller (to be described later). The polishing apparatus controlled by the controller jets out the polishing solution from the nozzle 10 toward the polishing target member 5, as shown in FIG. 3, to generate a jet 11. The polishing target zone is polished by spraying the polishing solution to it. In this case, the polishing ratio per unit changes depending on the spraying conditions of the polishing solution. Control with a polishing ratio of about 0.01 $\mu$m/min was experimentally observed. When the elasticity or non-elasticity of the abrasive particles to be suspended in the polishing solution is selected or the spraying speed and time are controlled on the basis of the data stored in the storage of the controller, the precision can be further improved. When hard abrasive particles are used and the spraying time is prolonged, deep polishing is becomes possible.

Furthermore, according to the polishing apparatus of this embodiment, when a distance D between the polishing target member 5 and the jet end of the nozzle 10 is changed, the spread of the jet 11 and the flow velocity at the spraying zone can be changed. When an angle θ of the direction of the normal to the surface of the polishing target zone and the jetting direction is changed, the flow of the jet 11 after spraying can also be changed. The preset values of D and θ are determined considering the polishing conditions, polishing depth and size, and the like.

(Second Embodiment)

The second embodiment will be described. Since the schematic arrangement of a polishing apparatus is the same as that of FIG. 1 described in the first embodiment, FIG. 1 will be used to describe it.

Figure 4A:
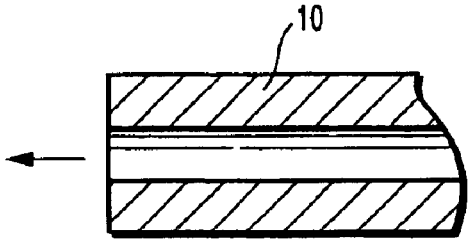
FIGS. 4A and 4B are views showing the schematic arrangements of nozzles applied to the second embodiment.
Figure 4B:
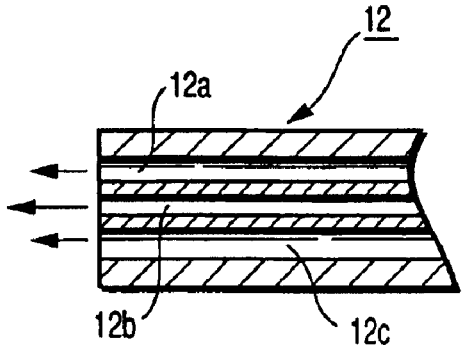

In FIG. 1, as the nozzle 10, a single-layer nozzle which jets out one type of polishing solution as shown in FIG. 4A is described. In the second embodiment, as shown in FIG. 4B, a nozzle 12 with a multiple structure having a plurality of jet ports 12*a*, 12*b*, and 12*c* is used. When the nozzle 12 as shown in FIG. 4B is used, different polishing solutions can be jetted out from the respective jet ports 12*a*, 12*b*, and 12*c*. Hence, the polishing conditions can be selected easily.

Figure 5A:
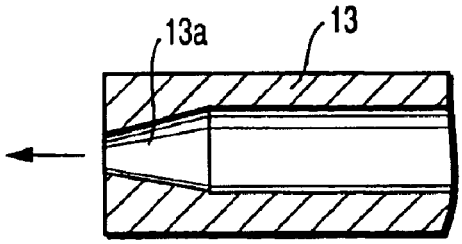
FIGS. 5A and 5B are views showing the schematic arrangements of other nozzles applied to the second embodiment.
Figure 5B:
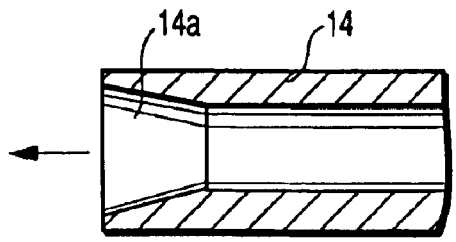

A nozzle 13 or 14 having a jet port with a different shape as shown in FIG. 5A or 5B can also be used. The nozzle 13 shown in FIG. 5A has a small flow section at its jet port 13*a*. The nozzle 14 shown in FIG. 5B has a large flow section at its jet port 14*a*. When such nozzles 13 and 14 are selectively used in accordance with the polishing conditions, high-precision polishing can be performed.

In the second embodiment, the nozzle 10, 12, 13, or 14 is detachably attached to the rotary base 9 provided to the nozzle table 8 shown in FIG. 1. In this case, for example, the nozzle is mounted on a rotary bas 9 with a screw. The nozzle mounting method can employ any structure as far as it facilitates nozzle centering and enables jetting of the polishing solution. A guide by means of fitting, a positioning pin, and the like are provided so that the direction of the nozzle 10, 12, 13, or 14 or the rotational direction about the axis becomes constant. As the material of the nozzle 12, 13, or 14 including the nozzle 10, a material having large hardness, e.g., a carbide alloy, ruby, diamond, silicon carbide, silicon nitride, tungsten carbide, or titanium nitride, is used. Alternatively, the surface of the nozzle is coated with this material.

(Third Embodiment)

The third embodiment will be described.

Figure 6:
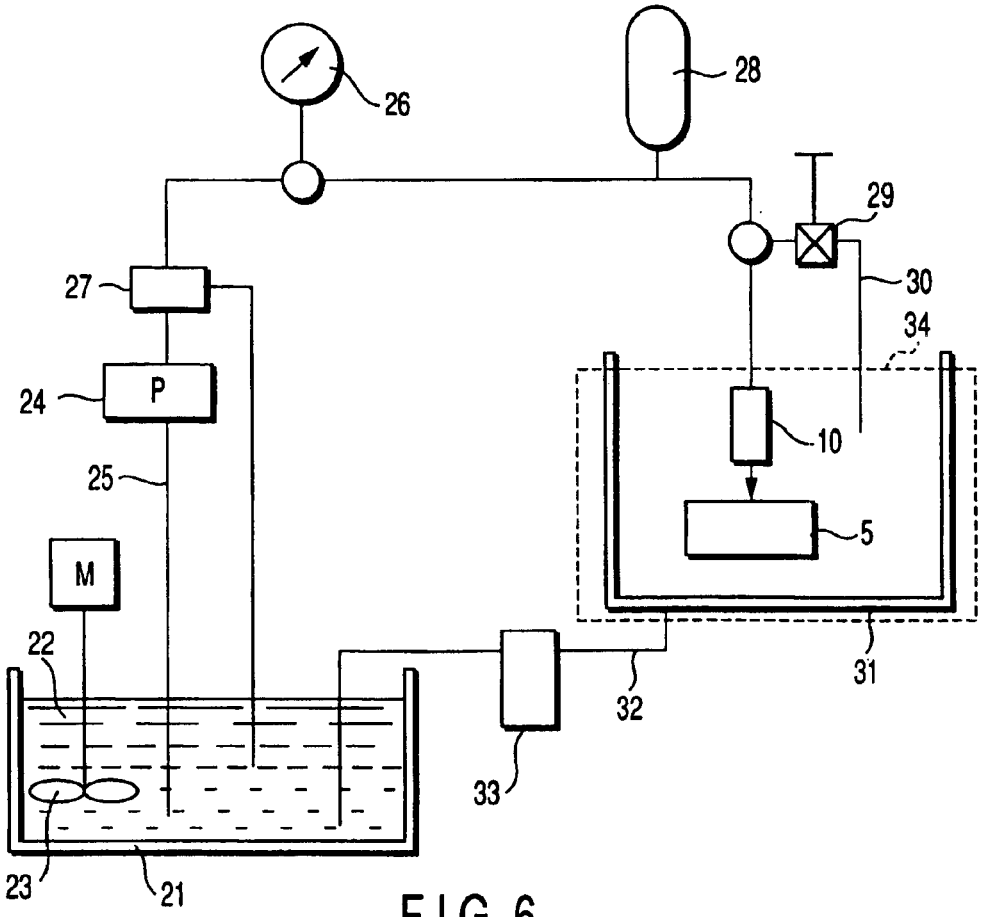
FIG. 6 is a view showing a schematic arrangement of a polishing solution supply apparatus applied to the third embodiment of the present invention.

FIG. 6 shows the schematic arrangement of a polishing solution supply apparatus to be applied to the polishing apparatus described with reference to FIG. 1.

Referring to FIG. 6, a tank 21 storing a prepared polishing solution 22 has an agitator 23 which prevents precipitation and maintains a uniform composition concentration. The polishing solution 22 in the tank 21 is fed by a pump 24 through a supply pipe 25 to the nozzle 10 of the spraying polishing apparatus described with reference to FIG. 1. The polishing solution 22 is then sprayed to the polishing target member 5. In this case, the pressure of the polishing solution to be fed to the nozzle 10 is measured by a pressure gauge 26. If the pressure of the polishing solution is excessively high, a relief valve 27 operates to return the polishing solution to the tank 21, and to stop the pump 24. The pump 24 is stopped also when the pressure of the polishing solution increases only to a predetermined range within a predetermined period of time, or is lower than the predetermined range for a predetermined period of time. In this case, a stop signal for the pump 24 is sent to the pump 24 via the controller shown in FIG. 7 (to be described later), or directly if the pump 24 has a control function. The operator may manually operate a stop switch to stop the pump 24.

When the polishing solution is jetted out from the nozzle 10, vibration sometimes occurs in the flow depending on the flow of the polishing solution in the supply pipe 25 and the jetting condition. Then, polishing is sometimes hindered. An accumulator 28 is provided to prevent this. In this case, accumulators having pipes with different thicknesses or an outlet/inlet port may also be used selectively. When vibration is actually detected, or the flow or jetting conditions suggest anticipated vibration, these accumulators are selectively used to avoid vibration.

A selector valve 29 is connected to the polishing solution supply side of the nozzle 10. When the nozzle is to be exchanged, it can be exchanged smoothly by feeding the polishing solution to a bucket 31 by the selector valve 29 via a release bypass 30. The selector valve 29 can also set the release bypass 30 side when the apparatus will not be used or during start-up of the apparatus. Then, inspection or the like of the flow of the polishing solution can be performed.

The polishing solution jetted out from the nozzle 10 and used for polishing is received by the bucket 31. The polishing solution is then returned from the bucket 31 to the tank 21 via a drain pipe 32. A filter 33 is connected midway along the drain pipe 32. The filter 33 removes polishing dust separated from the polishing target member 5 by utilizing a difference in nature, e.g., the size, specific weight, magnetism, and the like of the particles.

The nozzle 10, polishing target member 5, and bucket 31 are accommodated in a chamber 34 that forms a closed space. This prevents the polishing solution from entering other portions such as a sliding portion. In addition, the chamber 34 prevents the polishing solution from being scattered. When a plurality of nozzles 10 are provided, chambers 34 needs to be provided for the respective nozzles 10. Then, the polishing solution is prevented from being mixed, so that the quality of polishing can be maintained.

The composition and the concentration of the composition of the polishing solution used in this apparatus are determined in accordance with the material of the polishing target member 5, the polishing condition, the service life, the type of the solvent, and the like. Naturally, the polishing solution sometimes contains one component, e.g., water, a solvent, or an oil solution.

The abrasive particles contained in the polishing solution may be BK7 when the polishing target member 5 is made of BK7 as a typical lens material. Alternatively, the abrasive particles may be made of a material other than a resin, i.e., aluminum oxide or diamond, generally used as abrasive particles for polishing. In addition to the abrasive particles, a filler may be added to adjust the viscosity or specific weight or to prevent a chemical change such as oxidation.

With this polishing solution, a glass member such as a lens or prism, a film applied on the base by coating, e.g., a metal film, oxide film, or nitride film, a substrate such as a wafer or disk, a reference window for optical interference, and the like is polished as the polishing target member 5.

Figure 7:
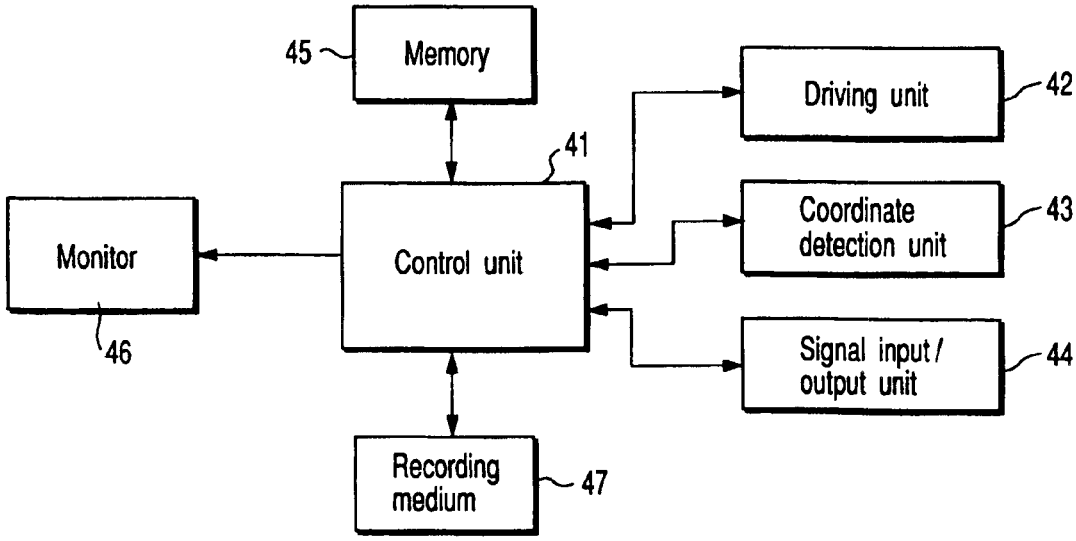
FIG. 7 is a diagram showing the schematic arrangement of a controller for the polishing solution supply apparatus applied to the third embodiment of the present invention.

FIG. 7 shows the schematic arrangement of the controller which controls the polishing solution supply apparatus as described above. Referring to FIG. 7, a control unit 41 is connected to a driving unit 42, coordinate detection unit 43, signal input/output unit 44, memory 45, and monitor 46. The control unit 41 can read data such as a program stored in a storage medium 47. The driving unit 42 drives the work-table 2, work rotation table 3, support arm 6, rotary base 7, nozzle table 8, rotary base 9, and the like of the spraying polishing apparatus described with reference to FIG. 1.

The coordinate detection unit 43 detects the position coordinates of the work-table 2 or nozzle 10, e.g., the position coordinates of respective axes that move in the directions A, B, and C. The signal input/output unit 44 controls the pressure of the polishing solution in the pipe of the polishing solution supply apparatus, or input/output of a signal indicating the operation state of the pump 24, relief valve 27, and the like which are described with reference to FIG. 6. The control unit 41 inputs/outputs, creates, stores, selects, and files the control program, the polishing conditions, and the shape data of the polishing target member 5. The results of these processes are displayed on the monitor 46 and stored in the memory 45. The recording medium 47 which stores the program performed by the control unit 41 can be of any type, for example, a hard disk provided in the control unit 41, an external host computer, magnetic disk, an optical disk or the like connected via a communication line or channel, or the like.

Figure 8:
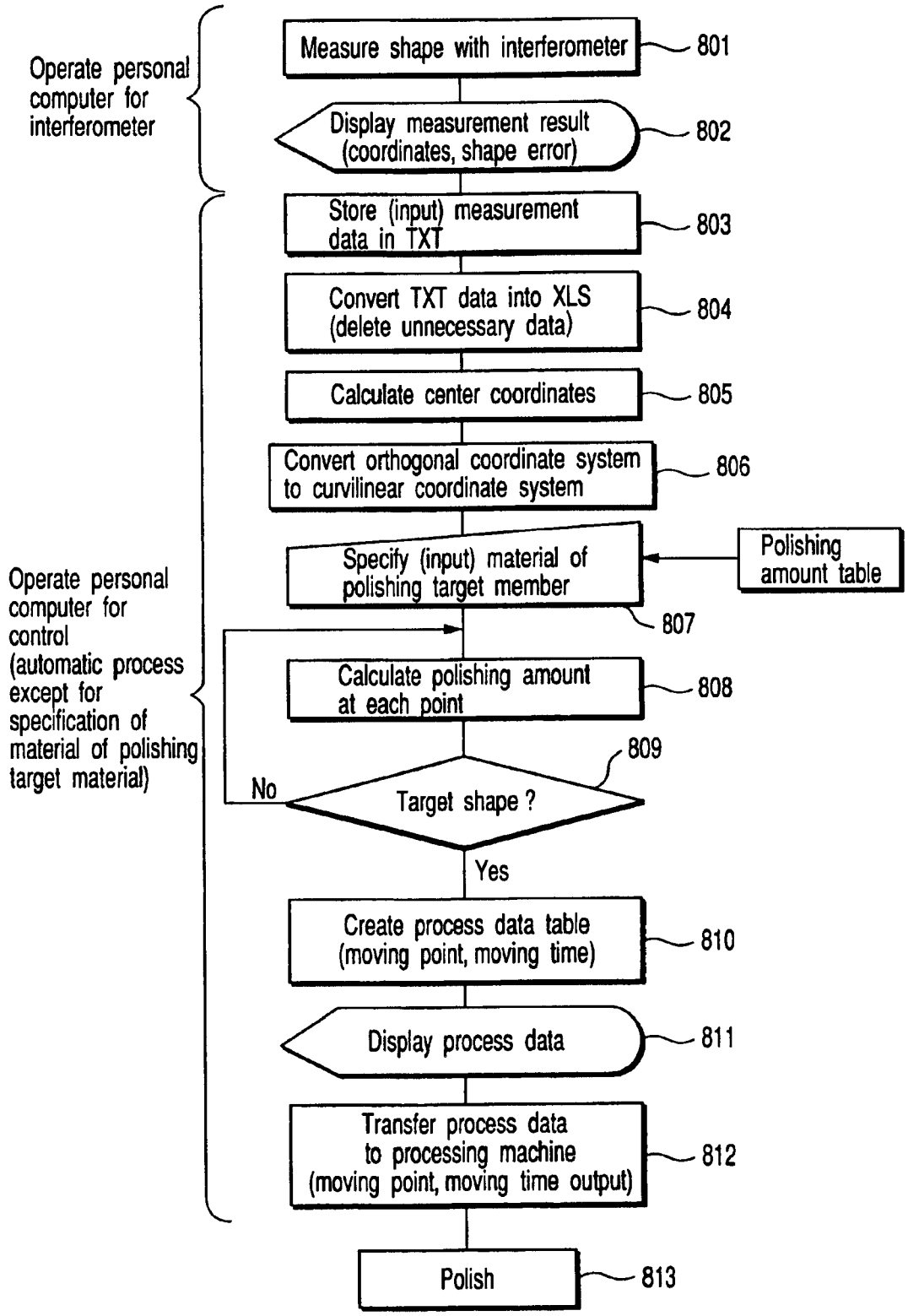
FIG. 8 is a flow chart for explaining polishing according to the third embodiment.

A procedure with which actual polishing is performed will be described with reference to the flow chart shown in FIG. 8.

In operating a personal computer for an interferometer, the shape of the surface of the polishing target member 5 is measured by an optical interferometer (step 801). The shape measurement result is input to the control unit 41, stored in the memory 45, and displayed on the monitor 46 simultaneously (step 802).

Subsequently, in operating a personal computer for control, data of the measurement result is converted into shape data that can be used for polishing (step 804). In this case, unnecessary data are deleted, and an ID and additional information are newly added.

In lens polishing, a method of polishing while rotating the lens about its center is employed. Thus, the center coordinates are obtained first from the entire shape of the lens surface (step 805). The shape data is then converted from an orthogonal coordinate system to a curvilinear coordinate system (step 806).

The material of the polishing target member 5 is specified, and a polishing amount (table) of a desired method is prepared (step 807). The polishing amounts of the respective zones are obtained on the basis of the table information and the shape data (step 808). The target shape is checked (step 809). After that, a process data table is created (step 810). The process data table includes polishing data for the respective zones, together with the material of the polishing target member 5, the type of the polishing solution, the shape of the nozzle 10, the conditions of the pipes, and the like, and a time duration for spraying out the polishing solution. The process data is displayed on the monitor 46 (step 811). The determined process data is transferred to the polishing apparatus (step 812), and the polishing target member 5 is polished (step 813).

The present invention is not limited to the above embodiments, but can be modified in various manners, when practicing it, without departing from its spirit.

The above embodiments include inventions of various levels. Various types of inventions can be extracted from appropriate combinations of the plurality of disclosed constituent elements. For example, assume that even when several ones are deleted from all constituent elements shown in the embodiments, the problem described in the column of the problem to be solved by the invention can be solved, and the effect described in the column of the effect of the present invention can be obtained. In this case, an arrangement from which these constituent elements are deleted can be extracted as an invention.

As has been described above, according to the present invention, there is provided a polishing apparatus and polishing method that can freely control the distance, angle, and the like as the polishing solution spraying conditions in accordance with the surface shape of the polishing target member, so that high-precision polishing can be realized, a program for causing the computer to execute polishing, and a recording medium for storing the program for executing this process.

The present invention can provide a polishing apparatus and polishing method for polishing the surface of an optical member or substrate by spraying a fluid or abrasive suspension to it, a control program for causing a computer to execute polishing, and a recording medium.

What is claimed is:

1. A polishing apparatus comprising:

a table on which an optical target member is placed; and at least one nozzle which forms and polishes a surface of the optical target member by spraying a polishing solution onto the surface of the optical target member, wherein the nozzle and the optical target member are movable relative to each other, and wherein an angle of the nozzle relative to the optical target member is changeable.

2. The polishing apparatus according to claim 1, wherein the table is rotatable.

3. The polishing apparatus according to claim 1, further comprising means for controlling a period of time during which the polishing solution is sprayed.

4. The polishing apparatus according to claim 1, wherein the nozzle is detachably attached to an arm of the polishing apparatus.

5. The polishing apparatus according to claim 1, wherein the nozzle is attached to the polishing apparatus such that a direction of the nozzle and a position of the nozzle in a rotational direction about an axis along a jetting direction of the polishing solution from the nozzle are made constant.

6. The polishing apparatus according to claim 1, further comprising means for displaying shape data of the optical target member prior to a polishing operation and for recording and displaying a process condition preset based on the shape data.

7. A polishing apparatus comprising:

a table on which a polishing target member is placed;

at least one nozzle which sprays a polishing solution onto a surface of the polishing target member;

measuring means for measuring a shape of the polishing target member;

polishing amount setting means for setting a polishing amount of each portion of the polishing target member based on measurement data produced by the measuring means;

processing condition setting means for setting a processing condition according to quality of material of the polishing target member and polishing information; and moving means for moving the nozzle and the polishing target relative to each other.

8. The polishing apparatus according to claim 7, wherein the table is rotatable.

9. The polishing apparatus according to claim 7, further comprising means for controlling a period of time during which the polishing solution is sprayed.

10. The polishing apparatus according to claim 7, wherein the nozzle is detachably attached to an arm of the polishing apparatus and a spraying angle of the nozzle is variable.

11. The polishing apparatus according to claim 7, wherein the nozzle is attached to the polishing apparatus such that a direction of the nozzle and a position of the nozzle in a rotational direction about an axis along a jetting direction of the polishing solution from the nozzle are made constant.

* * * * *